US007417598B2

(12) United States Patent
Navarro et al.

(10) Patent No.: US 7,417,598 B2
(45) Date of Patent: Aug. 26, 2008

(54) COMPACT, LOW PROFILE ELECTRONICALLY SCANNED ANTENNA

(75) Inventors: Julio A. Navarro, Kent, WA (US); Devin W. Hersey, Renton, WA (US); Michael H. Florian, Newcastle, WA (US); Gordon D Osterhues, Irvine, CA (US); Percy Yen, Irvine, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/594,387

(22) Filed: Nov. 8, 2006

(65) Prior Publication Data

US 2008/0106467 A1 May 8, 2008

(51) Int. Cl.
*H01Q 21/00* (2006.01)
*H01Q 1/38* (2006.01)

(52) U.S. Cl. ..... 343/853; 343/700 MS; 342/368; 342/372; 342/375

(58) Field of Classification Search ..... 343/700 MS, 343/853, 754, 753; 342/368, 372, 375
See application file for complete search history.

(56) References Cited

U.S. PATENT DOCUMENTS 4,851,856 A 7/1989 Altoz
5,030,961 A 7/1991 Tsao
5,099,254 A * 3/1992 Tsukii et al. ..... 343/853
5,276,455 A 1/1994 Fitzsimmons et al.
5,854,607 A * 12/1998 Kinghorn ..... 343/853
5,886,671 A 3/1999 Riemer et al.
6,424,313 B1 7/2002 Navarro et al.
6,429,816 B1 * 8/2002 Whybrew et al. ..... 343/700 MS
6,469,671 B1 10/2002 Pluymers et al.
6,580,402 B2 6/2003 Navarro et al.

(Continued)

FOREIGN PATENT DOCUMENTS

EP 1753073 A2 2/2007

(Continued)

OTHER PUBLICATIONS

UK Combined Search and Exam Report dated Mar. 5, 2008 received in connection with GB patent application GB0721852.2.

*Primary Examiner*—Hoang V Nguyen
(74) *Attorney, Agent, or Firm*—Harness, Dickey & Pierce, P.L.C.

(57) ABSTRACT

A compact, low profile electronically scanned antenna module is provided. The antenna module includes a multi-layer antenna integrated printed wiring board (AiPWB) that includes a radiator layer on a front surface. The radiator layer includes a plurality of RF radiating elements. The antenna module additionally includes a plurality of radiator electronics modules orthogonally connected to a back surface of the AiPWB. The electronics modules are interconnected with radiating elements through the AiPWB and include a plurality of beam steering electronic elements mounted to a multi layer conformable substrate. The orthogonal connections allow the antenna module to have outer dimensions that are substantially equal to the dimensions of a perimeter of the AiPWB. Additionally, frequency and scanning angle requirements of the antenna module can be increased by merely increasing the length of the electronics modules in the orthogonal direction to allow for additional beam steering electronic elements needed to accommodate the increased frequency and scanning requirements.

18 Claims, 6 Drawing Sheets

U.S. PATENT DOCUMENTS

| | | | | |
|---|---|---|---|---|
| 6,670,930 | B2 | 12/2003 | Navarro | |
| 6,900,765 | B2 | 5/2005 | Navarro et al. | |
| 6,989,791 | B2 | 1/2006 | Navarro et al. | |
| 2007/0152882 | A1 * | 7/2007 | Hash et al. | 343/700 MS |

FOREIGN PATENT DOCUMENTS

| | | | |
|---|---|---|---|
| GB | 2426876 | | 6/2006 |
| WO | WO 99/36992 | A2 | 7/1999 |
| WO | WO 02/23966 | A2 | 3/2002 |
| WO | WO 02/29469 | A1 | 3/2002 |

* cited by examiner

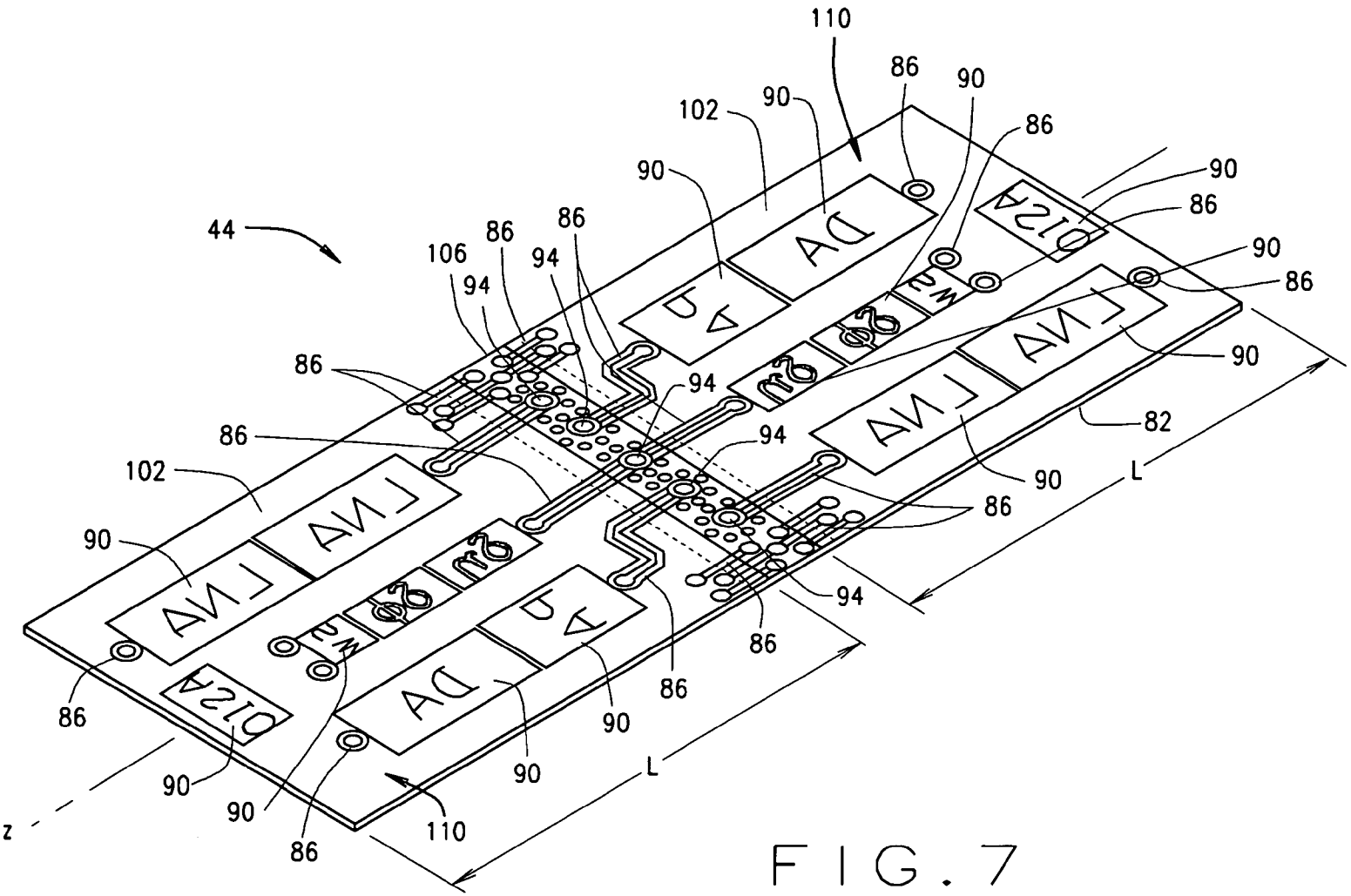
110
44
102
106
86
90
94
82
L
W2
DVI
DVI
DVI

COMPACT, LOW PROFILE ELECTRONICALLY SCANNED ANTENNA

FIELD

This disclosure relates to electronically scanned antennas, and more particularly to compact, low-profile architecture for electronically scanned antennas.

BACKGROUND

The statements in this section merely provide background information related to the present disclosure and may not constitute prior art.

Electronically scanned antennas, also commonly referred to as phased array antennas, are comprised of multiple radiating antenna elements, individual element control circuits, a signal distribution network, signal control circuitry, a power supply and a mechanical support structure. The total gain, effective isotropic radiated power ("EIRP") (with a transmit antenna) and scanning and side lobe requirements of the antenna are directly related to the number of elements in the antenna aperture, the individual element spacing and the performance of the elements and element electronics. In many applications, thousands of independent element/control circuits are required to achieve a desired antenna performance.

A phased array antenna typically requires independent electronic packages for the radiating elements and control circuits that are interconnected through a series of external connectors. As the antenna operating frequency (or beam scan angle) increases, the required spacing between the phased array radiating elements decreases. As the spacing of the elements decreases, it becomes increasingly difficult to physically configure the control electronics relative to the tight element spacing. This can affect the performance of the antenna and/or increase its cost, size and complexity. Consequently, the performance of a phased array antenna becomes limited by the need to tightly package and provide vertical interconnects from the electronics to the RF distribution network and radiating elements. As the number of radiating elements increases, the corresponding increase in the required number of external connectors (i.e., "interconnects") serves to significantly increase the cost of the antenna.

Additionally, multiple beam antenna applications further complicate this problem by requiring more electronic components and circuits to be packaged within the same module spacing. Conventional packaging approaches for such applications result in complex, multi-layered interconnect structures with significant cost, size and weight.

FIG. 1 illustrates one form of architecture, generally known as a "tile" architecture, used in the construction of a phased array antenna. With the tile architecture approach, an RF input signal is distributed into an array in a distribution layer 10 that is parallel to the antenna aperture plane. The distribution network 10 feeds an intermediate plane 12 that contains the control electronics 14 responsible for steering and amplifying the signals associated with individual antenna elements. A third layer 16 includes the antenna elements 18. The third layer 16 comprises the antenna aperture and typically includes a large plurality of closely spaced antenna elements 18 which are electronically steerable by the control electronics 14. Output signals radiate as a plurality of individually controlled beams from the antenna radiating elements 18. Additionally, with the tile architecture approach, the radiating element 18 spacing determines the available surface area for mounting the electronic components 14.

The tile architecture approach can be implemented for individual elements or for an array of elements. Additionally, the traditional tile architecture approach has the ability to support dual polarization radiators as a result of its coplanar orientation relative to the antenna aperture. Individual element tile configurations can also allow for complete testing of a functional element prior to antenna integration. Ideally, the tile configuration lends itself to most manufacturing processes and has the best potential for low cost if the electronics can be accommodated for a given element spacing. However, this configuration requires discrete interconnects for each layer in the structure, where the number of interconnects required is directly in accordance with the number of radiating elements of the antenna. Additionally, the mechanical construction of the individual tiles in the array typically contribute to limitations on the minimum element spacing that can be achieved.

A tile architecture configuration for a phased array antenna can also be implemented in multiple element configurations. As such, the tile architecture approach can take advantage of distributed, routed interconnects resulting in fewer components at the intermediate plane 12. The tile architecture approach also takes advantage of mass alignment techniques providing opportunities for lower cost antennas. The multiple element configuration, however, does not support individual element testing and consequently is more severely impacted by process yield issues confronted in the manufacturing process. Conventional enhancements to the basic tile architecture approach have involved multiple layers of interconnects and components, which increases antenna cost and complexity.

FIG. 2 illustrates a different form of packaging architecture known generally as a "brick" or "in-line" packaging architecture. With the brick architecture, the input signal is distributed in a 1×N feed layer 20. This distribution layer feeds N 1×M distributions 22-36 that are arranged perpendicular to the 1×N feed layer 20 and the antenna aperture plane. With the brick architecture, the radiating elements 38 on each distribution layer 22-36 are arranged in line with the element electronics 38 (shown in highly simplified form). Because of the in-line configuration of the radiating elements 38 and their orthogonal arrangement to the antenna aperture, the traditional brick architecture approach is typically limited to single polarization configurations. Like the tile architecture approach, however, the radiating elements can be packaged individually or in multiple element configurations as shown in FIG. 2. External interconnects are used between the input feed layer 20 and the distribution layers 22-36. Typically, the brick architecture approach results in an antenna that is deeper and more massive than one employing a tile architecture approach for a given number of radiating elements. The brick architecture approach, however, can usually accommodate tighter radiating element spacing since the radiating element electronics are packaged in-line with the radiating elements 38. The ability to test individual radiating elements 38 prior to antenna integration is limited, with a corresponding rework limitation at the antenna level.

The assignee of the present application is a leading innovator in phased array antenna packaging and manufacturing processes involving modified tile and brick packaging architectures. The prior work of the assignee in this area is described in U.S. Pat. No. 5,886,671 to Riemer et al, issued Mar. 23, 1999 and U.S. Pat. No. 5,276,455 to Fitzsimmons et al, issued Jan. 2, 1994. The disclosures of both of these patents are hereby incorporated by reference into the present application. While the approaches described in these two patents address many of the issues and limitations of tile and brick packaging architectures, these approaches are still space limited as the frequency increases.

Accordingly, there is a need for a packaging architecture for a phased array antenna module which permits even closer radiating element spacing to be achieved, and which allows for even simpler and more cost efficient manufacturing processes to be employed to produce a phased array antenna.

SUMMARY

A compact, low profile electronically scanned antenna module is provided. In accordance with various embodiments, the antenna module includes a multi-layer antenna integrated printed wiring board (AiPWB) that includes a radiator layer on a front surface. The radiator layer includes a plurality of RF radiating elements. The antenna module additionally includes a plurality of radiator electronics modules orthogonally connected to a back surface of the AiPWB. The electronics modules are interconnected with radiating elements through the AiPWB and include a plurality of beam steering electronic elements mounted to a multi layer conformable substrate. The orthogonal connections allow the antenna module to have outer dimensions that are substantially equal to the dimensions of a perimeter of the AiPWB. Additionally, frequency and scanning angle requirements of the antenna module can be increased by merely increasing the length of the electronics modules in the orthogonal direction to allow for additional beam steering electronic elements needed to accommodate the increased frequency and scanning requirements.

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

FIG. 7 shows the radiator electronics module shown in FIG. 6 in a laid out view illustrating a multi layer conformable substrate of the radiator electronics module, in accordance with various embodiments.

DETAILED DESCRIPTION

Figure 1:
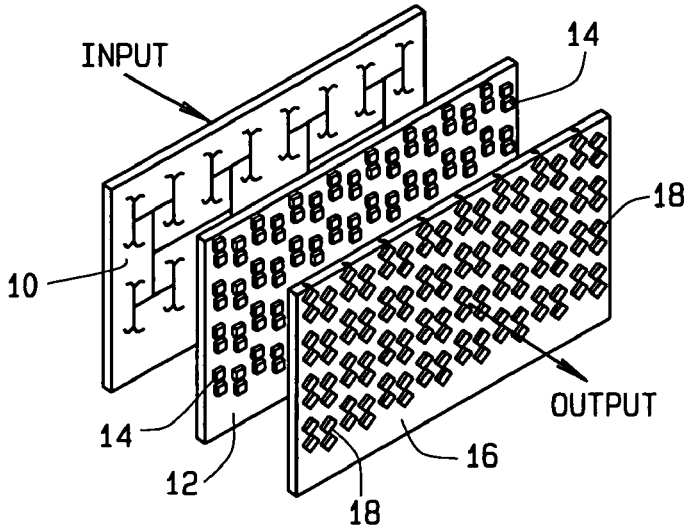
FIG. 1 PRIOR ART
FIG. 1 is a simplified diagram of a tile architecture approach known to be used in constructing an electronically steerable phased array antenna.
Figure 2:
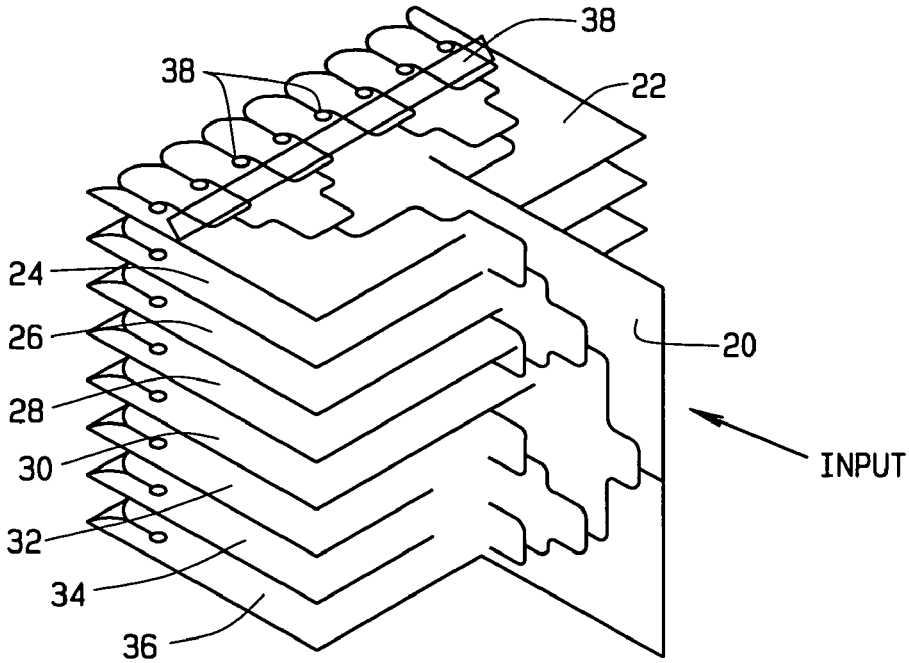
FIG. 2 PRIOR ART.
FIG. 2 is a diagram of a traditional brick architecture approach also known to be used in constructing a phased array antenna.

The following description is merely exemplary in nature and is in no way intended to limit the present teachings, application, or uses. Throughout this specification, like reference numerals will be used to refer to like elements.

Figure 3:
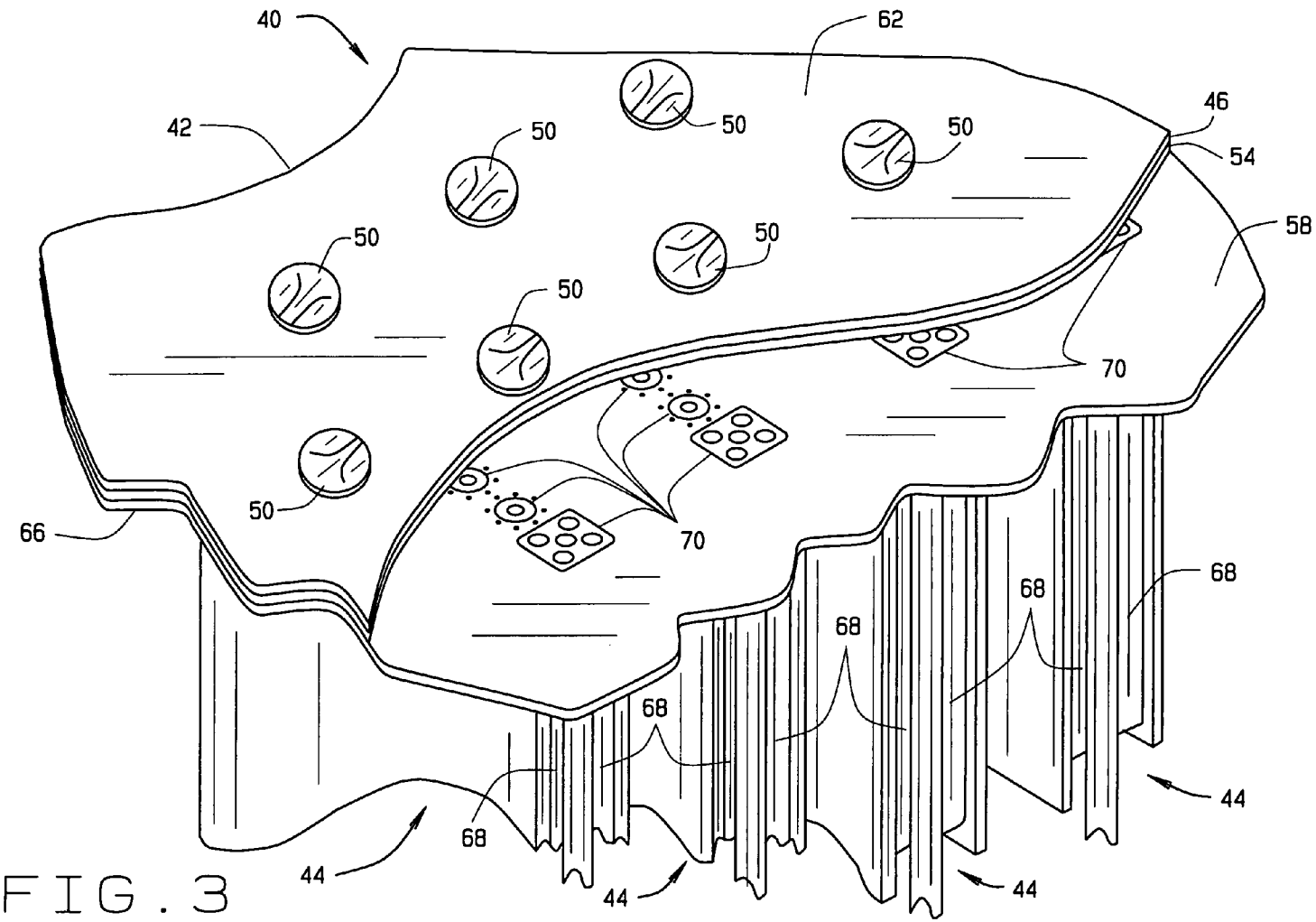
FIG. 3 is an isometric sectional view of a compact, low profile electronically scanned antenna module, in accordance with various embodiments of the present disclosure.

FIG. 3 illustrates an isometric sectional view of a compact, low profile electronically scanned antenna module 40, in accordance with various embodiments of the present disclosure. Generally, the antenna module 40 includes a multi layer antenna integrated printed wiring board (AiPWB) 42 and a plurality of radiator electronics modules 44 substantially orthogonally connected to the AiPWB 42. In various embodiments, the AiPWB includes at least a radiator layer 46 having a plurality of radio frequency radiator elements 50 mounted thereon, a distribution layer 54 including a plurality of integrated, monolithic distribution networks for distribution of radio frequency (RF) signals during transmit and/or receive functions, and a radiator electronics module connection layer 58.

Figure 4:
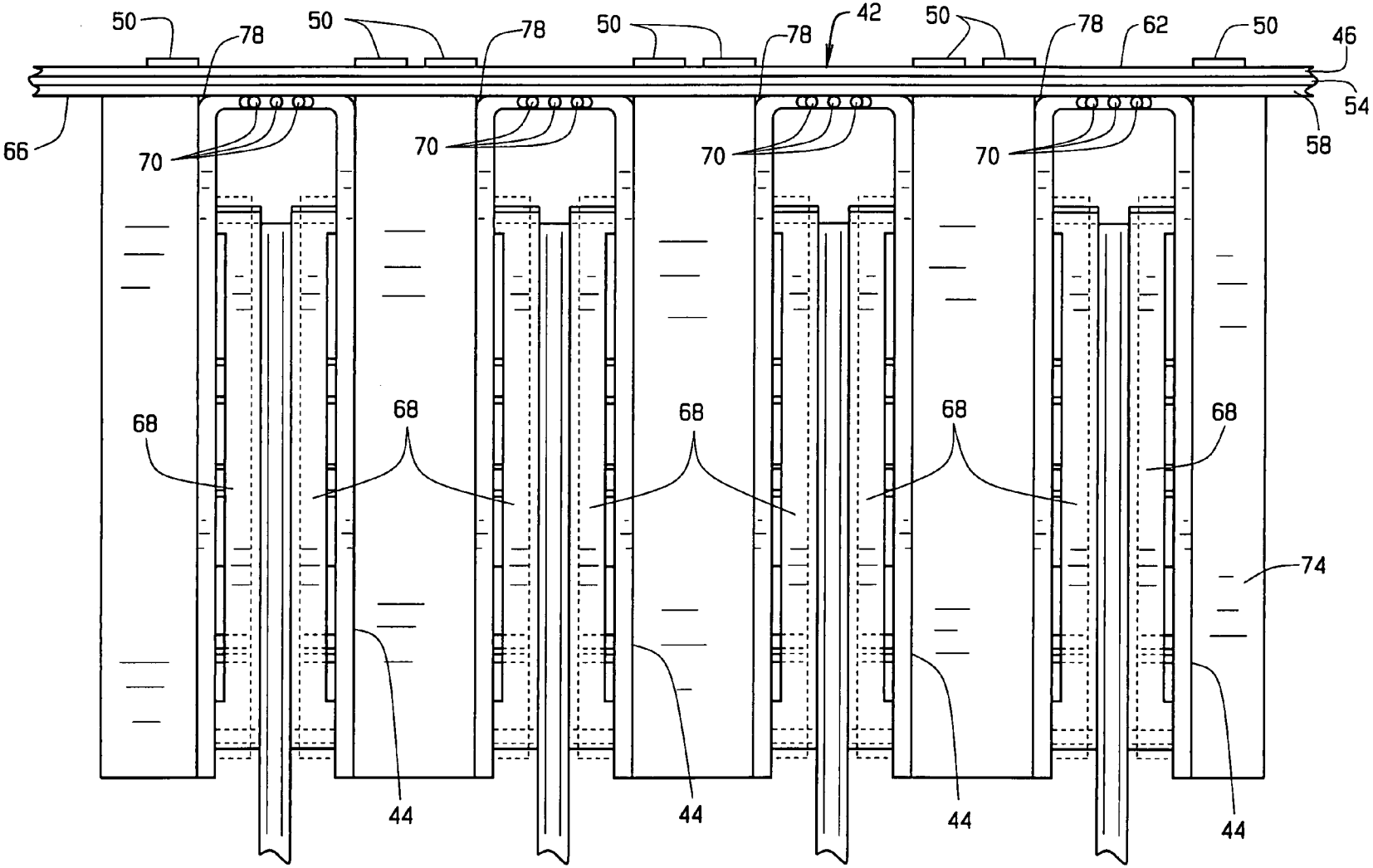
FIG. 4 is a side view of a section of the compact, low profile electronically scanned antenna module shown in FIG. 3, in accordance with various embodiments.

Referring also now to FIG. 4, the radiator elements 50 are mounted to a front surface 62 of the AiPWB, i.e., a front surface of the radiator layer 46, and the radiator electronics modules 44 are directly connected to a back surface 66 the AiPWB 42, i.e., a back surface 66 of the connection layer 58. The radiator electronics modules 44 include a plurality of beam steering electronic elements 68 responsible for steering and amplifying the RF signals transmitted from and/or received by the radiator elements 50 and distributed via the distribution layer 54. The radiator electronics modules 44 are interconnected with radiating elements 50 through the multiple layers of the AiPWB 42. More particularly, the radiator electronics modules 44 are directly connected to the AiPWB back surface 66 using low pressure contacts 70. Any low pressure contacts or connection process suitable for keeping the radiator electronics modules 44 aligned and maintained over temperature and vibration can be implemented and remain within the scope of the present disclosure. For example, in various embodiments ball grid array (BGA) contacts are utilized to directly connect the radiator electronics modules 44 to the AiPWB back side 66 because a BGA is generally a self-aligning, repeatable batch process that can be scaled to the perimeter and surface area dimensions of the AiPWB 42.

Figure 5:
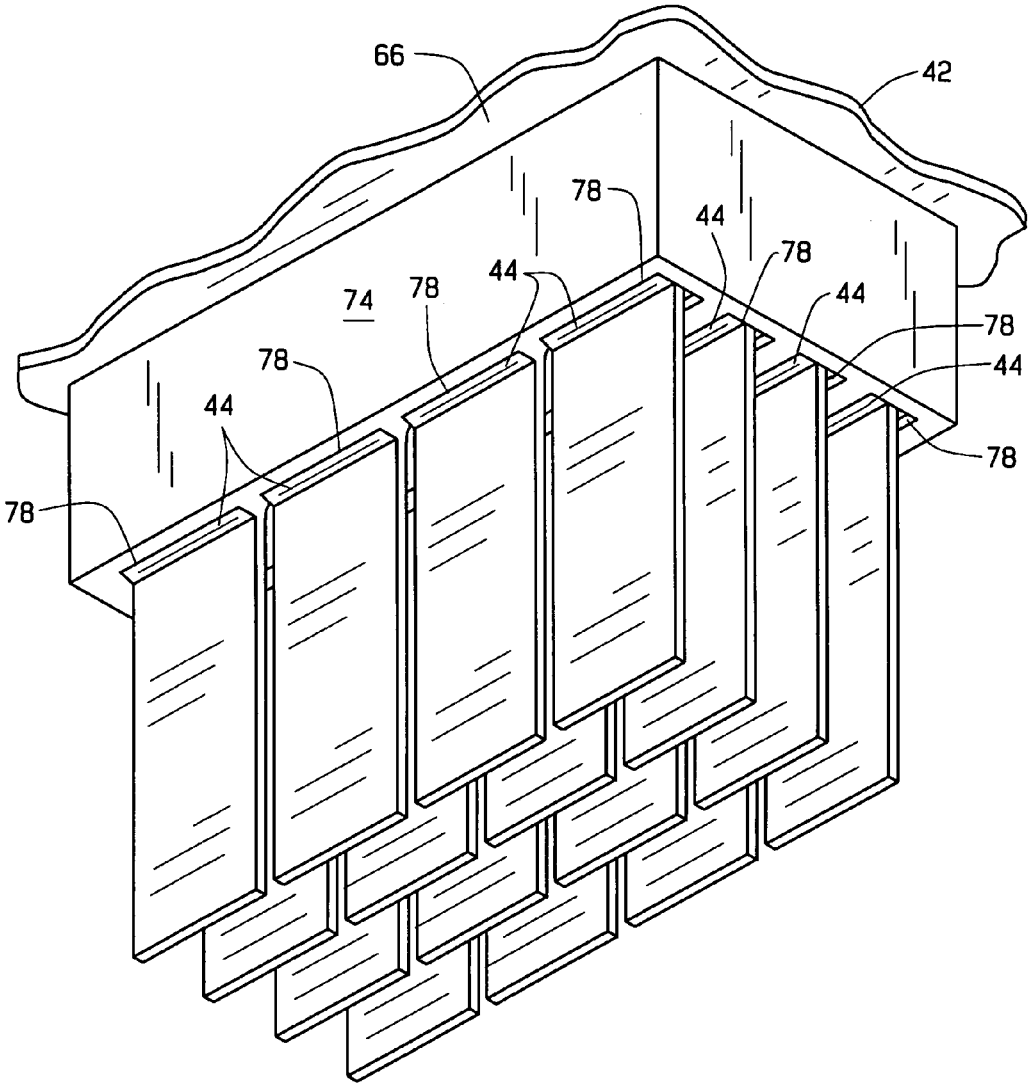
FIG. 5 is an isometric view of a portion of the compact, low profile electronically scanned antenna module shown in FIG. 3 including a support and alignment fixture, in accordance with various embodiments.

Referring now to FIGS. 4 and 5, in various embodiments, the electronically scanned antenna module 40 additionally includes at least one radiator electronics module support and alignment fixture 74. The support and alignment fixture 74 provides additional support and alignment of the connection of the radiator electronics module to the AiPWB 42. As best shown in FIG. 5, the support and alignment fixture 74 is mounted to the back surface 66 of the AiPWB 42 and includes a plurality of slots 78 that extend through the support and alignment fixture 74. Each radiator electronics modules 44 is positioned with a slot 78 and directly connected to the AiPWB 42, as described above. The radiator electronics modules 44 each have a friction fit within the respective support and alignment fixture slot 78. Thus, the support and alignment fixture 74 holds the radiator electronics modules 44 snuggly in place, i.e., in proper alignment, and supports the radiator electronics modules 44 in the substantially orthogonal relationship with the AiPWB 42. Each support and alignment fixture 74 can include any desired number of slots 78, for example, as exemplarily illustrated in FIG. 5, each support and alignment fixture can include sixteen slots 78. However, the support and alignment fixture 74 could just as readily include four, eight, twelve, thirty-two or any other desired number of slots 78.

Figure 6:
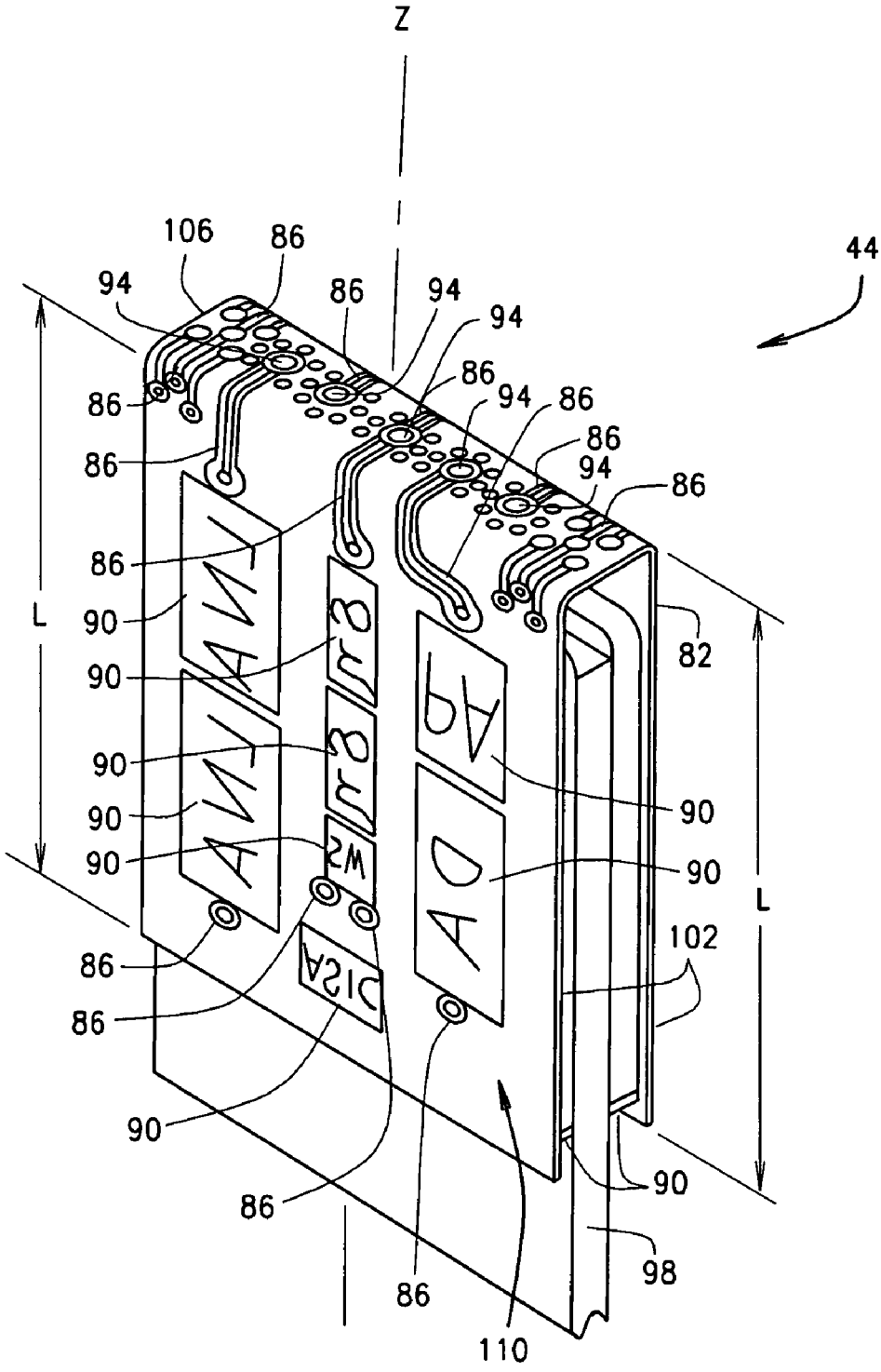
FIG. 6 is an isometric view of a radiator electronics module included in the compact, low profile electronically scanned antenna module shown in FIG. 3, in accordance with various embodiments.

Referring now to FIGS. 6 and 7, in accordance with various embodiments, each radiator electronics module 44 includes a multi layer conformable, i.e., flexible, substrate 82 having integral integrated, monolithic transmission lines and distribution feed lines 86 formed therewith or etched into the substrate 82. Each electronics module 44 additionally includes a plurality of beam steering electronic elements 90 mounted thereon and interconnected by the transmission and distribution lines 86. In various embodiments, the conformable substrate 82 is built photo lithographically such that the beam steering electronic elements are simply mounted to the back of the substrate 82. The beam steering electronic elements can include any electronic element necessary to process the input and/or output RF signals between the radiator elements 50 and the distribution layer 54 of the AiPWB 42. For example, the beam steering electronic elements can include monolithic microwave integrated circuits (MMICs) and application specific integrated circuits (ASICs), power amplifiers (PAs), phase shifter, low noise amplifiers (LNAs), drivers, attenuators, switches, etc. A plurality of input/output pads 94 are similarly formed on the substrate 82. Each group of input/output pads 84 is in electrical communication with one or more of the beam steering electronic elements 90 and at least one of the radiator layer 46 and the distribution layer 54.

The conformable substrate 82 can be formed in a variety of shapes during assembly such that the resulting electronics modules 44 can be adapted for implementation in a wide variety of antenna configurations to suit specific applications. For example, in accordance with various embodiments, the substrate 82 is populated with the beam steering electronic elements 90 with the substrate 82 in a substantially flat configuration (FIG. 7), then the substrate 82 is effectively folded in half and mounted around a support mandrel 98 (FIG. 6). Therefore, each resulting electronics module 44 includes a pair of wing panels 102 extending orthogonally from a narrow base 106 by which each electronics module 44 is connected to the AiPWB 42, as described above. In various implementations, the beam steering electronic elements 90 can be die bonded to the mandrel 98. The support mandrel 98 provides support along a longitudinal axis Z of each electronics module 44 that is substantially orthogonally oriented with the AiPWB 42 when the electronics modules 44 are connected to the AiPWB 42. In various embodiments, the support mandrel 98 is constructed of a metal, e.g., aluminum, and extends beyond distal ends of the wing planes 102, thus, serving as a heat sink to dissipate heat from the beam steering electronic elements 90, as best shown in FIG. 5.

As will be appreciated, the integrally formed monolithic transmission lines 45 and feed transmission lines 50 eliminate the need for external interconnects, thus significantly reducing the overall manufacturing complexity and overall cost of the antenna module 40. Additionally, as described above, the beam steering electronic elements 90 are positioned vertically with respect to the AiPWB 42. Accordingly, an antenna aperture, formed by outer perimeter dimensions of the AiPWB 42, is also orthogonal to the plane on which the electronics modules 44, and thus, the beam steering electronic elements 90, are oriented. Since the electronics modules 44 are substantially orthogonally connected to the AiPWB 42, the outer dimensions of the antenna module 40 are substantially equal to the dimensions of a perimeter of the AiPWB 24.

Each wing panel 102 includes beam steering electronics 90 associated with at least one radiator element 50. More specifically, the beam steering elements 90 on each wing panel 102 independently operate to control the beam steering and transmission processing, and/or signal reception processing for at least one radiator element 50. Thus, each electronics module 44 includes two separate radiator beam steering control circuits 110, one on each wing panel 102, that controls the beam steering and transmission processing, and/or signal reception processing for at least two radiator elements 50. For example, in various embodiments, the interconnected beam steering electronic elements 90 on each wing panel 102 can comprise a separate radiator beam steering control circuit 110, i.e., two separate beam steering control circuits 110, wherein each beam steering control circuit 110 is associated with, and controls beam steering and signal processing of one of the radiator elements 50. Alternatively, in various embodiments, the interconnected beam steering electronic elements 90 on each wing panel 102 can comprise a separate radiator beam steering control 110, i.e., two separate beam steering control circuits 110, wherein each beam steering control circuit 110 is associated with, and controls beam steering and signal processing of a selected group of two or more radiators 50.

Furthermore, it should be understood that although FIGS. 6 and 7 illustrate a single beam steering control circuit 110 formed on each wing panel 102, that one or more beam steering control circuits 110 can be formed on each wing panel 102. For example, each wing panel 102 can have formed thereon, two, three or more beam steering control circuits 110. Accordingly, each beam steering control circuits 110 would be associated with and control the beam steering and signal processing of one, or a selected group of two or more, radiator elements 50.

The orthogonal positional relationship between the AiPWB 42 and the radiator electronics modules 44 provides a significantly increased availability of chip attachment area per radiating element 50. That is, since each radiator electronics module 44 is orthogonally connected to and extends orthogonally from, the AiPWB 42, each wing panel 102 can have generally any length L, along the Z axis, needed to mount all the beam steering electronic elements 90 necessary to accommodate the desired scanning angle and frequency of the respective antenna module 40, for any specific application. More particularly, as the desired scanning angle and frequency of the respective antenna module 40 increase, so also do the number of beam steering electronic elements 90. By orthogonally connecting the electronics modules 42 to the AiPWB 42, the length L of the wing panels 102 can be configured to generally any length necessary to accommodate all the electronic elements 90 needed to meet the desired scanning angle and frequency requirements. Accordingly, since the antenna module 40 can be longitudinally 'grown', or expanded, along the Z axis, away from the AiPWB 42, the antenna module 40 can provide generally any desired beam steering angle, frequency and performance specification without increasing the perimeter dimensions of the AiPWB 42. Thus, the aperture of the antenna module 40 will remain the same regardless of the complexity, beam steering angle, frequency and performance of the antenna module 40 of the specific application. Furthermore, functionality and complexity of the AiPWB 42 can be added by merely adding additional layers to the AiPWB 42 without increasing the size of the AiPWB 42 and thus the size of the antenna aperture.

It should be understood that the phased array antenna module 40, as described herein, can be utilized in full-duplex communication applications, to provide either transmit or receive functions. Or, the phased array antenna module 40, as described herein, can be utilized in half-duplex communication and radar sensor applications, to provide both transmit and receive functions selectable through a switch or circulator.

The packaging architecture of the antenna module 40, described herein, allows for wider, more consistent beam steering at higher operating frequencies by providing 'growth' or expansion in the Z direction. As described, the antenna module 40 can be utilized as a transmit/receive module which can be used for radar sensor applications as well as half-duplex communication systems well into millimeter wavelengths.

From the foregoing, it will be appreciated that the conformable substrate 82, described herein, lends itself readily to a variety of implementations. Importantly, the elimination of large pluralities of external interconnects allows extremely tight radiating element spacing to be achieved, while also reducing the cost and manufacturing complexity of a high frequency phased array antenna incorporating the radiator electronics module 42. This enables phased array antennas having large pluralities of radiating elements to be constructed even more cost effectively than with previously developed packaging architectures. As a result, the antenna module 40, described herein, allows electronically scanned, phased array antennas to be used in a variety of implementations where previously developed packaging architectures would have resulted in an antenna that would be too costly to implement.

The description herein is merely exemplary in nature and, thus, variations that do not depart from the gist of that which is described are intended to be within the scope of the teachings. Such variations are not to be regarded as a departure from the spirit and scope of the teachings.

What is claimed is:

1. A compact, low profile electronically scanned antenna module comprising:

a multi-layer antenna integrated printed wiring board (AiPWB) including a radiator layer comprising a plurality of RF radiating elements on a front surface of the AiPWB; and a plurality of radiator electronics modules orthogonally connected to a back surface of the AiPWB such that outer dimensions of the antenna module are substantially equal to the dimensions of a perimeter of the AiPWB, the electronics modules interconnected with radiating elements through the AiPWB, each electronics module comprising a multi layer conformable substrate including integrated, monolithic transmission and distribution lines that interconnect a plurality of beam steering electronic elements mounted to the conformable substrate, the interconnected beam steering electronic elements comprising two separate radiator beam steering control circuits, each beam steering control circuit associated with one of the radiators.

2. The antenna module of claim 1, wherein the interconnected beam steering electronic elements comprise two separate radiator beam steering control circuits, each beam steering control circuit associated with a selected group of two or more radiators.

3. The antenna module of claim 1, wherein the interconnected beam steering electronic elements comprise at least four separate radiator beam steering control circuits, each beam steering control circuit associated with at least one of the radiators.

4. The antenna module of claim 1, wherein each electronics module comprises the conformable substrate including the interconnected beam steering electronic elements effectively folded in half around a support mandrel such that each electronics module includes a pair of wing panels extending orthogonally from a narrow base by which each module is connected to the AiPWB.

5. The antenna module of claim 1, wherein the beam steering electronic elements include one or more phase shifters, low noise amplifiers, application specific integrated circuits and power amplifiers.

6. The antenna module of claim 1, wherein a length of the electronics modules, orthogonal to the AiPWB, can vary in accordance with the number of beam steering elements required to accommodate a desired frequency and scanning angle of the antenna module without changing the perimeter dimensions of the AiPWB nor the outer dimensions of the antenna module.

7. The antenna module of claim 1, wherein each electronics module is directly connected to the AiPWB back surface using a low pressure contact connection.

8. The antenna module of claim 1, wherein each electronics module is directly connected to the AiPWB back surface using a ball grid array connection.

9. The antenna module of claim 1, wherein the module further comprises at least one support and alignment fixture mounted to the back surface of the AiPWB, the supporting an alignment fixture including a plurality of slots therethrough in which the electronics modules snuggly fit to provide support and alignment of the electronics modules connected to the AiPWB back surface.

10. The antenna module of claim 1, wherein the AiWBP, the radiating elements and the interconnected electronics module are configured for at least one of transmitting and receiving RF signals.

11. A compact, low profile electronically scanned antenna module comprising:

a multi-layer antenna integrated printed wiring board (AiPWB) including a distribution layer for distributing radio frequency (RF) signals and a radiator layer comprising a plurality of RF radiating elements on a top surface of the AiPWB for at least one of transmitting and receiving the RF signals; and a plurality of radiator electronics modules directly connected to a bottom surface of the AiPWB to orthogonally extend from the bottom surface such that outer dimensions of the antenna module are substantially equal to the dimensions of a perimeter of the AiPWB, each electronics module comprising a multi layer conformable substrate including a plurality of interconnected beam steering electronic elements mounted thereon that form at least two separate radiator beam steering control circuits, each beam steering control circuit associated with at least one of the radiators.

12. The antenna module of claim 11, wherein the conformable substrate further includes a plurality of integrated, monolithic transmission and distribution lines that interconnect the beam steering electronic elements mounted to the conformable substrate.

13. The antenna module of claim 11, wherein each electronics module comprises the conformable substrate including the interconnected beam steering electronic elements effectively folded in half around a support mandrel such that each electronics module includes a pair of wing panels extending orthogonally from a narrow base by which each module is directly connected to the AiPWB.

14. The antenna module of claim 11, wherein a length of the electronics module, orthogonal to the AiPWB, can vary in accordance with the number of beam steering elements required to accommodate a desired frequency and scanning angle of the antenna module without changing the perimeter dimensions of the AiPWB or the outer dimensions of the antenna module.

15. The antenna module of claim 11, wherein the module further comprises at least one support and alignment fixture mounted to the back surface of the AiPWB, the supporting an alignment fixture including a plurality of slots therethrough in which the electronics modules frictionally fit to provide support and alignment of the electronics modules connected to the AiPWB back surface.

16. A method for forming a compact, low profile electronically scanned antenna module, said method comprising:

providing a multi-layer antenna integrated printed wiring board (AiPWB) including a radiator layer comprising a plurality of RF radiating elements on a front surface of the AiPWB; and orthogonally coupling a plurality of radiator electronics modules directly to a back surface of the AiPWB such that outer dimensions of the antenna module are substantially equal to the dimensions of a perimeter of the AiPWB, the electronics module interconnected with radiating elements through the AiPWB wherein orthogonally coupling the plurality of radiator modules directly to the back surface of the AiPWB comprises mounting a plurality of beam steering electronic elements to a multi layer conformable substrate including integrated, monolithic transmission and distribution lines that interconnect the beam steering electronic elements.

17. The method of claim 16, wherein orthogonally coupling the plurality of radiator modules directly to the back surface of the AiPWB comprises effectively folding the conformable substrate including the interconnected beam steering electronic elements in half around a support mandrel such that each electronics module includes a pair of wing panels extending orthogonally from a narrow base by which each module is directly connected to the AiPWB.

18. The method of claim 16, wherein orthogonally coupling the plurality of radiator modules directly to the back surface of the AiPWB comprises orthogonally coupling the plurality of radiator modules directly to the back surface of the AiPWB such that a length of the electronics modules, orthogonal to the AiPWB, can vary in accordance with the number of beam steering elements required to accommodate a desired frequency and scanning angle of the antenna module without changing the perimeter dimensions of the AiPWB nor the outer dimensions of the antenna module.

* * * * *